US006994323B2

(12) United States Patent
Carbajal

(10) Patent No.: US 6,994,323 B2
(45) Date of Patent: Feb. 7, 2006

(54) CARPET INSTALLATION COMBINATION TOOL

(76) Inventor: Enrique Carbajal, 3571 Wilson Ave., San Diego, CA (US) 92104

( * ) Notice: Subject to any disclaimer, the term of this patent is extended or adjusted under 35 U.S.C. 154(b) by 0 days.

(21) Appl. No.: 11/133,908

(22) Filed: May 20, 2005

(65) Prior Publication Data

US 2005/0263746 A1 Dec. 1, 2005

Related U.S. Application Data

(60) Provisional application No. 60/574,356, filed on May 25, 2004.

(51) Int. Cl.
*A47G 27/04* (2006.01)
*F16B 7/10* (2006.01)
*F16D 1/00* (2006.01)

(52) U.S. Cl. ..... 254/212; 254/200; 254/206; 254/210

(58) Field of Classification Search ..... 254/200, 254/201, 206, 209, 210, 211, 212
See application file for complete search history.

(56) References Cited

U.S. PATENT DOCUMENTS 2,108,506 A * 2/1938 Owens ..... 254/212
2,160,134 A * 5/1939 Fanning ..... 254/200
3,300,182 A * 1/1967 Bussard ..... 254/212
3,441,252 A * 4/1969 Koppelmans ..... 254/206
3,498,661 A * 3/1970 Graziano ..... 294/8.6
3,599,936 A * 8/1971 Crain, Jr. ..... 254/212
3,692,278 A * 9/1972 Payson ..... 254/212
3,791,624 A * 2/1974 Payson ..... 254/212
3,917,225 A * 11/1975 Payson ..... 254/210
4,076,213 A * 2/1978 Payson ..... 254/210
4,230,302 A * 10/1980 Crain, Jr. ..... 254/212
4,577,837 A * 3/1986 Berg et al. ..... 254/212
4,934,658 A * 6/1990 Berg et al. ..... 254/212
5,288,057 A * 2/1994 Listau ..... 254/212
5,681,031 A * 10/1997 Foley ..... 254/209
5,938,182 A * 8/1999 Goodrich et al. ..... 254/209
2005/0161651 A1 * 7/2005 Despins ..... 254/200

* cited by examiner

*Primary Examiner*—Kathy Matecki
*Assistant Examiner*—Evan Langdon
(74) *Attorney, Agent, or Firm*—Richard D. Clarke

(57) ABSTRACT

The present invention is directed to a carpet installation combination tool consisting of a knee kicker unit with a stretcher adapter and a unique telescoping linked extension rod assembly that may be coupled to a removable stationary wall pressure attachment or a removable pivotal wall pressure attachment. An alternate embodiment will have a removable knee kicker pad attachment so that the stretcher adapter is not required. The knee kicker unit will incorporate an extendable lever arm to insert pressure on the head unit assembly while stretching the carpet for both the kicking operation and the stretching operation.

19 Claims, 4 Drawing Sheets

CARPET INSTALLATION COMBINATION TOOL

This application claims the benefit of U.S. Provisional Patent Application Ser. No. 60/574,356, filed on May 25, 2004.

FIELD OF THE INVENTION

The present invention relates to an improvement in the field of carpet installation. More particularly this invention relates to the tools used for the installation process, but not by way of limitation, to a novel combination tool that can be used as a stretching tool, as well as a knee kicking tool, minimizing the quantity and weight of tools that an individual installing carpet must carry to the jobsite.

BACKGROUND OF THE INVENTION

The installation of wall-to-wall carpeting often involves stretching the carpet to obtain a smooth, flat appearance. This generally entails installing barber tack strips around the perimeter of the area to be covered with carpet. The carpet is then rolled out in the room, usually over some padding then rough cut to shape, and seamed. One side of the carpet is attached to the barbed tack strip along one side of a room and then stretched to the opposite side of the room where the carpet is attached to the barbed tack strip on that side. This process removes any wrinkles or creases in the carpeting.

During the above-described method of installing carpets, the carpet installer is required to use various tools for stretching the carpet. The most commonly used tool is the carpet knee kicker, which is typically constructed from an elongated rod having a head with a plurality of downwardly extending carpet-gripping members or prongs at one end, and at the other end a kneepad. The elongated rod typically includes an offset bend adjacent to the head to provide clearance for the kneepad so that the head will be flat on the floor for maximum engagement with the carpet surface. The elongated rod portion of the device will be parallel with the floor to transmit to the head the maximum force of a blow to the kneepad by the carpet installer.

Carpet installers using this device must get down on their hands and knees, use the carpet gripping head of the kicker to engage the carpet close to the edge to be stretched, and then kick the knee pad using a knee, thus stretching the carpet. The edge of the carpet is then pressed down onto the tack strip, which secures the stretched carpet in place. Any final trimming of the edge is accomplished and the edge is neatly tucked between the tack strip and the wall to give a finished appearance. Carpet kickers are extremely popular because they are inexpensive devices and because they are particularly useful for stretching carpet in small areas, such as hallways and stairways. However, a carpet kicker has limited power for stretching carpet in larger areas. Additionally the effectiveness of the knee kicker also depends upon the size and weight of the installer. Over a long period, the repeated bumping of the knee by installers can cause serious damage to the knees of individuals involved in the installation of carpet.

Wide varieties of other tools have been devised for stretching carpet in large rooms. These tools usually consist of an enlarged head unit with a plurality of downwardly extending carpet-gripping members or prongs connected to a pressure rod consisting of one or more extension members. Average large rooms take between five and eight of these separate extension rods that range in length from three to four feet long. The extended pressure rod has a pivotal end that presses against the base of the opposite wall that the carpet is being stretched toward. Carpet installers are required to carry all of their tools to the location that the carpet is being installed, which can be very cumbersome and may take several trips back to the transportation vehicle. This patent endeavors to reduce the number and weight of tools along with improving the capability of the tools used to install carpet.

A wide variety of single purpose tools for stretching carpet along with many different kinds of knee kickers are known in the art. For example, U.S. Pat. No. 4,076,213 of Buford L. Payson discloses an extendible locking tube assembly of outer and inner telescoping tubes. The outer tube internally carries a locking collar having an obliquely inclined central aperture that slidably receives an elongated locking member. An end of the elongated member is removably attached to the inboard end of the inner tube. The locking collar has a radial lug that projects exteriorly from the outer tube and bears against an abutment carried on the outside of the outer tube. The locking collar is biased into a position preventing retraction of the elongated member and its dependent inner tube. A lever, attached to the collar, projects exteriorly from the outer tube on the side opposite the abutment, thereby permitting a single-handed release of the locking mechanism. When the assembly is employed, as in its preferred application with a carpet stretcher, one can release the locking mechanism without shifting one's position from that taken for operation of the carpet stretcher.

This patent describes a good example of the single purpose tools that make use of an assembly of many outer and inner telescoping tubes connected to the gripper head but cannot easily be used as a knee kicker.

U.S. Pat. No. 4,119,338 of Clarito R. Agcaoili describes a carpet stretcher or kicker operable by engagement with the knee of an operator, the carpet stretcher or handle having a shank, a head with carpet-engaging pins adjustably mounted therein positioned at one end of the shank, and a kicking plate having a padded cover at the other end, the shank being formed of telescoping shank members which may be rotated ninety degrees with respect to each other for disengagement, or moved longitudinally with respect to each other to obtain the desired shank length, and then rotated ninety degrees with respect to the original relative position to lock the members axially with respect to each other.

This patent describes a stretcher or kicker tool that has been designed specifically as a single purpose knee kicker device with a unique length adjustment, but doesn't have the capabilities to be extended to push against an opposite wall.

U.S. Pat. No. 4,538,846 of Jerry M. Alexander tells of a plurality or kit of brace assemblies for a carpet stretcher of the type having a carpet gripping head supported by a plurality of elongated telescoping tubular sections that are adjustable to vary the effective length of the head from a fixed support. Three interchangeable brace assemblies are provided, each of which may be substituted by the installer for the standard wall engaging foot on the end telescopic section. Each of the braces is adapted to fit around a fixed discrete vertical support commonly found in areas where carpets are installed such as support posts. All the brace assemblies include a U-shaped retainer and a tubular base. The largest of these brace assemblies includes a U-shaped arcuate retainer that is adapted to fit around and grasp one of the cylindrical support posts in the carpet installation area. This retainer has a non-pivotal connection to a base that snaps in the telescopic tubular sections of the stretcher. A second brace assembly is provided in the kit having a smaller U-shaped retainer with a rectangular shaped interior surface adapted to grasp a rectangular support in the carpet area. This brace has a vertical pivotal connection between its retainer and base. A third brace assembly is provided in the kit having an even smaller U-shaped retainer with a vertical pivotal interconnection to its base.

This patent describes a carpet stretcher with a variety of interchangeable brace units with telescoping sections connected between U-shaped retainers and the head member, but does not have the capability of being converted into a knee kicker to be used in more confined areas.

U.S. Pat. No. 5,129,696 of Patrick S. Underwood describes an adjustable carpet stretcher that has an outer tubular member, a first inner tubular member within the outer tubular member and a telescoping second inner tubular member within the outer tubular member. There is a locking member and an outer tubular member stabilizer bushing. There is a securing bushing releasingly attached to the second inner tubular member by a second inner tubular member fastener. A mounting bushing and a spacer member are on the second inner tubular member. A mounting plate is releasingly secured to the securing bushing. A carpet skid is releasingly attached to the mounting bushing. There is a kneepad and a kneepad-retaining member. A carpet gripping head has a base plate and a primary tooth plate, adjustably and removably attached to the base plate, which has a plurality of primary teeth thereon. A primary tooth plate adjustment member, adjustably attached to the base plate and to the primary tooth plate, adjusts a depth to which the primary teeth of the primary tooth plate may penetrate the carpet. At least one secondary tooth plate, removably attached to the base plate, has a plurality of secondary teeth thereon. There may be a tooth plate stabilizer bushing to reduce movement of the primary tooth plate. There is a light device to illuminate an area near the gripping head and a power source for the light device.

This patent describes a carpet stretching tool, but is primarily a knee kicker with a unique cushioned kneepad, gripping head unit and a light device to illuminate an area near the gripping head, but cannot be adapted to work as a stretcher that will extend to put pressure at the base of an opposite wall.

U.S. Pat. No. 5,288,057 of Ewald E. Listau discloses a carpet stretching device using a power stretching adapter attached to a standard carpet kicker. The stretching adapter is formed from a frame having an anchor plate attached to the front of the frame for anchoring the device between the wall and tack strip adjacent to the carpet edge to be stretched. A handle is provided which is pivotally attached along its lower portion to the back of the frame. A clamp is located at the bottom of the handle for attaching the handle to a standard carpet kicker adjacent to the head of the kicker, so that the head will be positioned between the anchor plate and the clamp. The device functions by placing the handle upright, placing the anchor between the wall and tack strip, engaging the carpet pile with the carpet kicker head, and pivoting the top of the handle down towards the knee pad of the carpet kicker, forcing the kicker head towards the anchor, thus stretching the carpet. A kicker assembly is also provided for forcing the stretched carpet into engagement with the tack strip.

This patent discloses a device that is a power stretching adapter attached to a standard carpet kicker, but it does not supply the attachments to make it a stretcher or have the attachments required to extend the device putting pressure on the opposite wall. This device relies on the pressure of the installer's knee against the kneepad of the device.

U.S. Pat. No. 6,669,174 B 1 of Christopher L. Vita describes a knee-less kicking tool for stretching a carpet. A base rests on the carpet. A head is attached to the base and engages and stretches the carpet when an apparatus for propelling the head is activated. The apparatus includes a pair of rods that extend across the base and a ram. The ram has a body that slides on the pair of rods. When the ram is slid forwardly on the pair of rods and impacts upon the base, the head is caused to move forward and stretch the carpet. The ram further has a handle that extends from the body thereof and is grabbed by the hand of a user and used to slide the ram forwardly, and a weight that extends upwardly from the body thereof and which increases the impact of the ram on the base when the ram is slid forwardly on the pair of rods.

This patent describes a knee-less kicking tool for stretching a carpet that uses weights to hold the device in position, and sliding a weighted ram instead of using the knee to stretch the carpet. This device cannot be used as a stretcher to push against an opposite wall, along with the fact that it greatly increases the weight that the carpet installers have to carry to the jobsite.

None of the foregoing prior art teaches or suggests the particular unique features of the carpet installation combination tool, clarifying the need for further improvements in the devices used to install carpeting.

In this respect, before explaining at least one embodiment of the invention in detail it is to be understood that the invention is not limited in its application to the details of construction and to the arrangement of the components set forth in the following description or illustrated in the drawings. The invention is capable of other embodiments and of being practiced and carried out in various ways. It is also to be understood that the phraseology and terminology employed herein are for the purpose of description and should not be regarded as limiting.

SUMMARY OF THE INVENTION

The principle advantage of this invention is to minimize the number of tools required in the process of installing carpet.

Another advantage of this invention is to reduce the weight of the tools required in the process of installing carpet.

Another advantage of this invention is to create a single combination tool that can function as a knee kicker as well as a carpet stretcher.

Another advantage of this invention is to enhance the capabilities of the tools required in the process of installing carpet by incorporating the lever action power capabilities to the knee kicker that is commonly used on commercially available carpet stretchers.

And still another advantage is to create a carpet installation combination tool that has the capability of expanding the width of one or both sides of the gripper head with side extension units for the knee kicking operation as well as the stretching operation.

A further advantage is to create a carpet installation combination tool with telescoping extension members that are permanently linked together as a single telescoping extension rod.

And still a further advantage of this invention is to add a new and unique device to the area of carpet installation.

The present invention is directed to a carpet installation combination tool consisting of a knee kicker unit with a stretcher adapter and a unique telescoping linked extension rod assembly that may be coupled to a removable stationary wall pressure attachment or a removable pivotal wall pressure attachment. An alternate embodiment will have a removable knee kicker pad attachment so that the stretcher adapter is not required. The knee kicker unit will incorporate an extendable lever arm to insert pressure on the head unit assembly while stretching the carpet for both the kicking operation and the stretching operation.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention. There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

BRIEF DESCRIPTION OF THE DRAWINGS

The accompanying drawings, which are incorporated into and form a part of this specification, illustrate embodiments of the invention and together with the description, serve to explain the principles of this invention.

DETAILED DESCRIPTION OF THE PREFERRED EMBODIMENTS

Figures 1, 2:
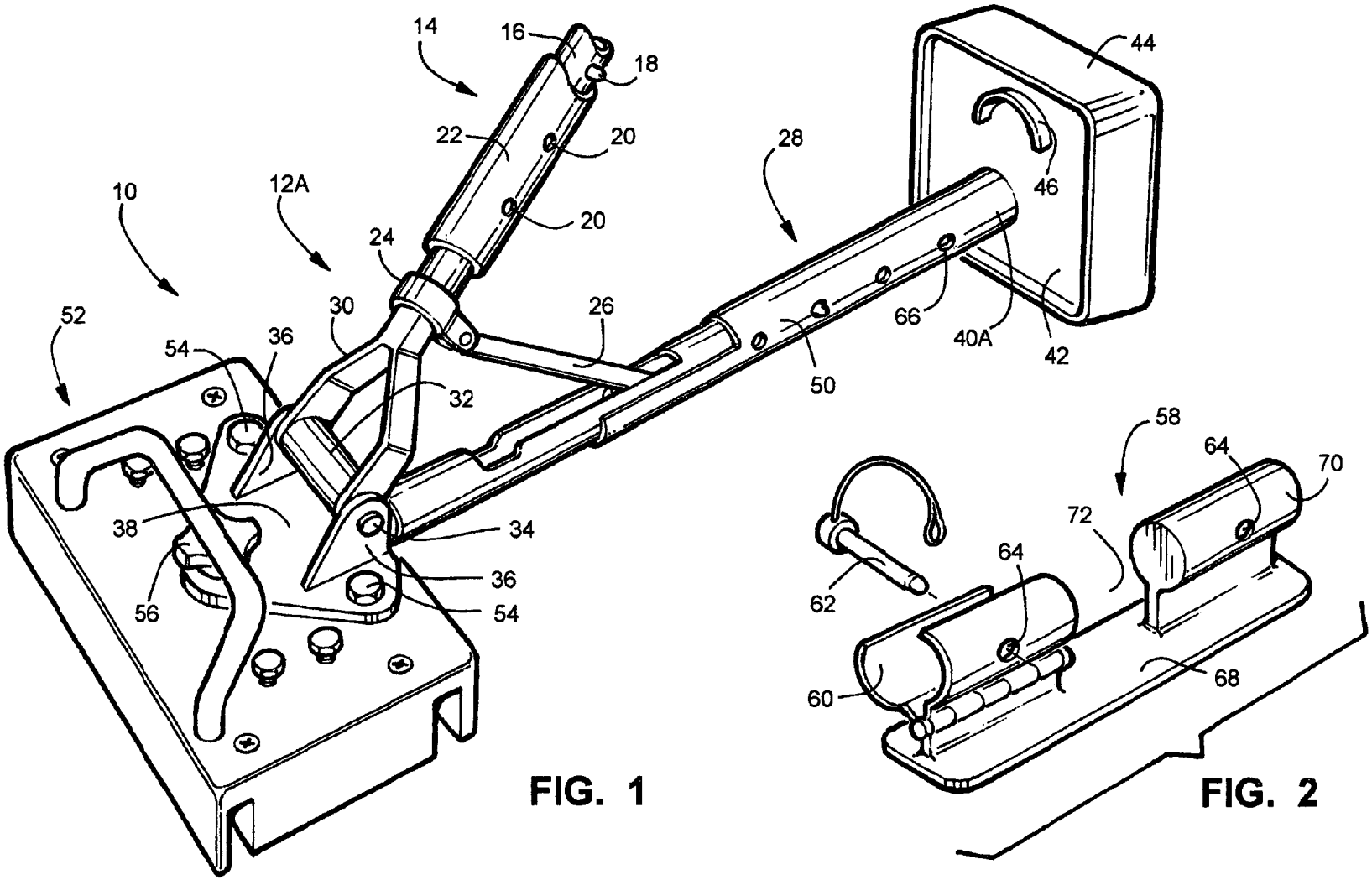
FIG. 1 depicts a perspective view of the knee kicker portion of the carpet installation combination tool with the lever arm extended, constructed in accordance with the present invention.
FIG. 2 depicts a perspective view of the stretcher adapter with the hinged clamp mechanism open and the locking pin exploded away, constructed in accordance with the present invention.

Referring now to the drawings, wherein similar parts of the carpet installation combination tool 10 are identified by like reference numerals, there is seen in FIG. 1 a perspective view of the knee kicker portion 12A of the carpet installation combination tool 10 with the lever arm assembly 14 extended in an upward position. The lever arm assembly 14 consists of a lever arm central tubular member 16 having a conventional spring-loaded ball detent 18 that will engage within one of a plurality of orifices 20 in the lever arm extension tube 22 to increase the length and leverage on the carpet stretching mechanism. A lever arm hinge bracket 24 is attached to the lever arm central tubular member 16 with the pressure arm 26 connecting to the extendable pressure rod assembly 28. Adjacent to the lever arm hinge bracket 24, the lever arm assembly 14 is formed into a yoke section 30. The lever arm yoke section 30 has a spacer 32 and a pivot pin 34 attaching to two brackets 36 on the head mounting plate 38. The pressure rod assembly 28 is attached at the distal end 40A to the knee kicker mounting plate 42 with the knee kicker cushioned pad 44 attached on the knee kicker portion 12A. The knee kicker mounting plate 42 will also incorporate a lever arm locking support 46 in which the distal end 48 of the pressure rod extension tube 50 will engage. The head mounting plate 38 is attached to the head unit assembly 52 by the means of mounting screws 54 and hand knob 56.

FIG. 2 illustrates a perspective view of the stretcher adapter 58 with the hinged clamp mechanism 60 shown open and the locking pin 62 exploded away. The hinged clamp mechanism 60 has been designed to clamp around the distal end 40A of the pressure rod extension tube 50 with the locking pin 62 going through the locking pin orifices 64 in the stretcher adapter 58 and the locking pin orifices 66 in the distal end 40A of the pressure rod extension tube 50. The hinged clamping mechanism 60 is attached to a support plate 68 adjacent to the extension rod receiver 70 with a gap 72 allowing clearance for the knee kicker cushioned pad 44. Similar locking pin orifices 64 will mate with similar locking pin orifices 66 in the distal end of the telescoping linked extension rod 74 for the engagement of a similar second locking pin 62.

Figure 3:
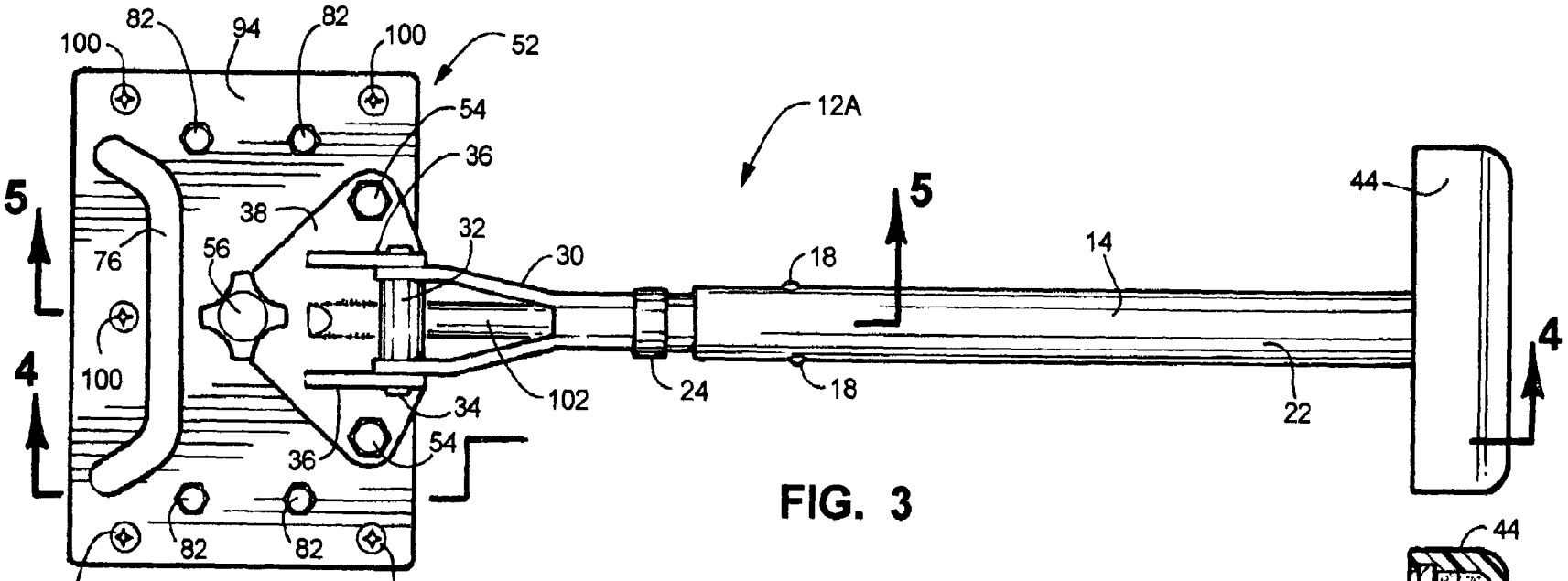
FIG. 3 depicts a plan view of the knee kicker portion of the carpet installation combination tool, constructed in accordance with the present invention.

FIG. 3 depicts a plan view of the knee kicker portion 12A of the carpet installation combination tool 10 illustrating the relative location and relationship of the knee kicker cushioned pad 44, the lever arm assembly 14 in the retracted position and the pressure rod extension tube 50 held in place by the means of the conventional spring loaded ball detents 18, and the location of the head unit assembly 52. Clearly depicted in this view is the location of the head mounting plate 38 with the mounting screws 54 and the support handle 76.

Figure 4:
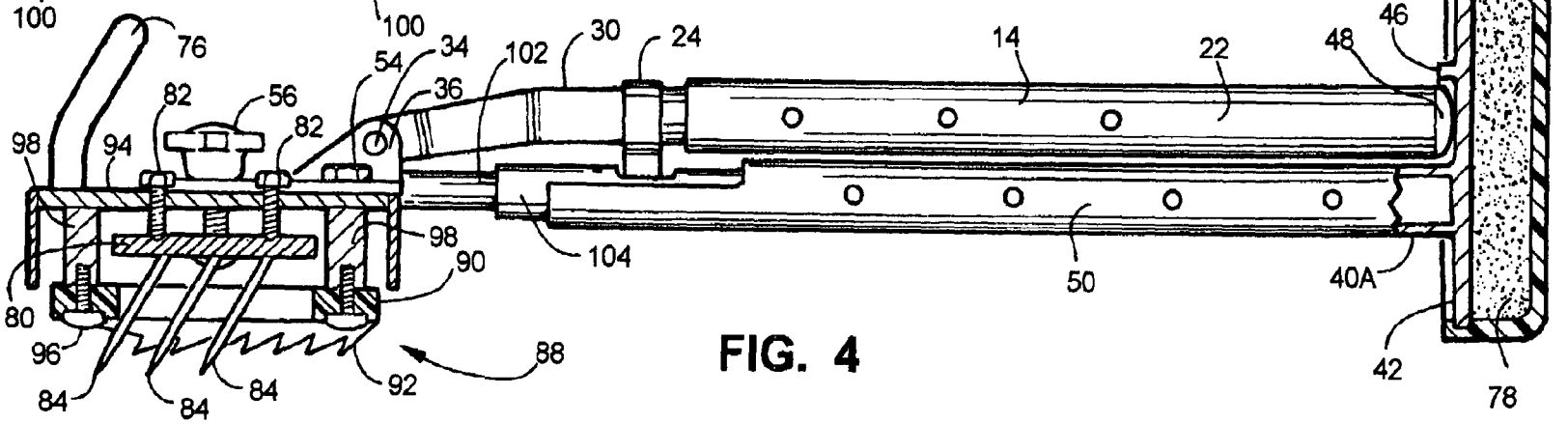
FIG. 4 depicts a side elevation of the knee kicker portion of the carpet installation combination tool sectioned through the left side of the head unit and knee pad, constructed in accordance with the present invention.

FIG. 4 depicts a side elevation of the knee kicker portion 12A of the carpet installation combination tool 10 further illustrating the relative location and relationship of the knee kicker cushioned pad 44, the lever arm assembly 14 in the retracted position having the distal end 40A of the pressure rod extension tube 50 locked in position by the lever arm locking support 46. The knee kicker cushioned pad 44 has been shown in cross section to identify the inner foam padding 78. The head unit assembly 52 has been shown in cross section clarifying the operation of how the hand knob 56 adjusts the height of the adjustable prong plate 80 by tightening against the four jacking screws 82 that can be raised or lowered. A plurality of prongs 84 are attached in rows across the adjustable prong plate 80, the prongs 84 are angled to resist the pull of the carpet during the stretching operation. The prongs 84 are aligned in rows to match the slots 86 in conventional gripper pads 88. The conventional gripper pads 88 consist of a plastic section 90 with slots 86 across it and having rows of sheet metal stamped teeth 92 imbedded into the plastic. The conventional gripper pads 88 are attached to the head unit main plate 94 of the head unit assembly 52 by the means of screws 96 into spacer blocks 98 that are held in place by screws 100.

Figure 5:
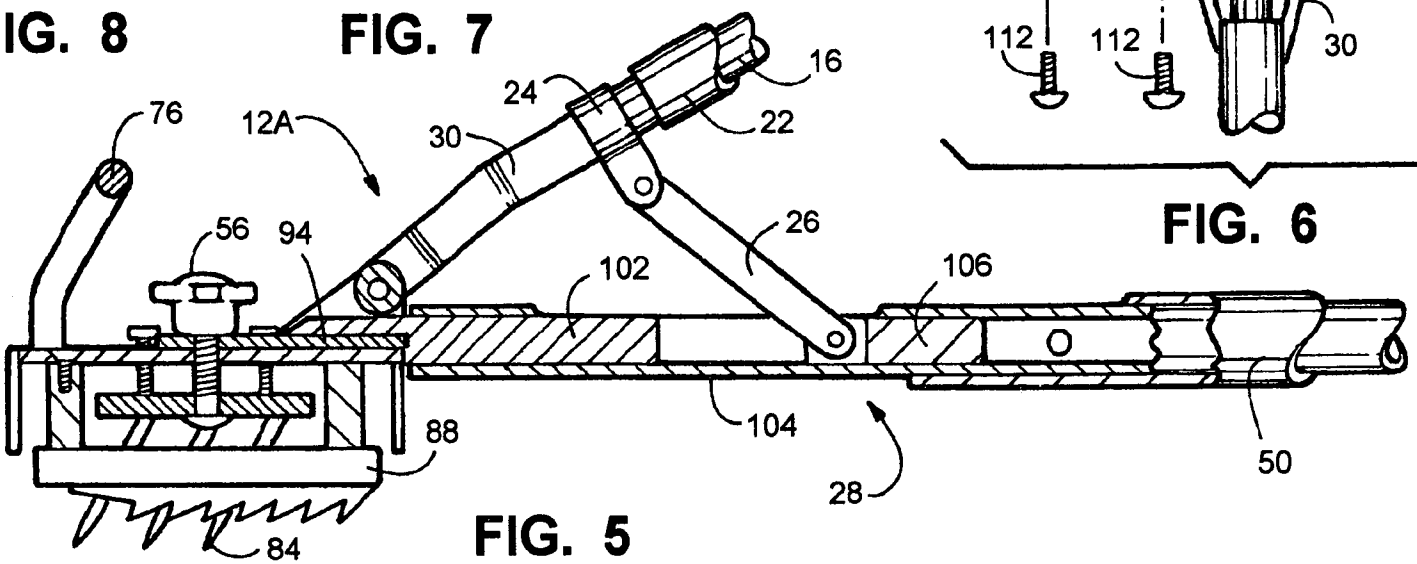
FIG. 5 depicts a side elevation of the knee kicker portion of the carpet installation combination tool sectioned on the center line, constructed in accordance with the present invention.

FIG. 5 depicts a side elevation of the knee kicker portion 12A of the carpet installation combination tool 10 sectioned on the center line to clarify the operations of the lever arm assembly 14 within the pressure rod assembly 28. A pressure rod mounting shaft 102 is rigidly attached to the head unit main plate 94 on which the pressure rod sliding tubular member 104 translates. When the lever arm assembly 14 is moved up and down the pressure arm 26 pushes the pivot insert 106 that is attached within the pressure rod sliding tubular member 104. This action lengthens the pressure arm 26 exerting axial force against the head unit assembly 52, forcing the prongs 84 engaged in the carpet to stretch the material.

Figure 6:
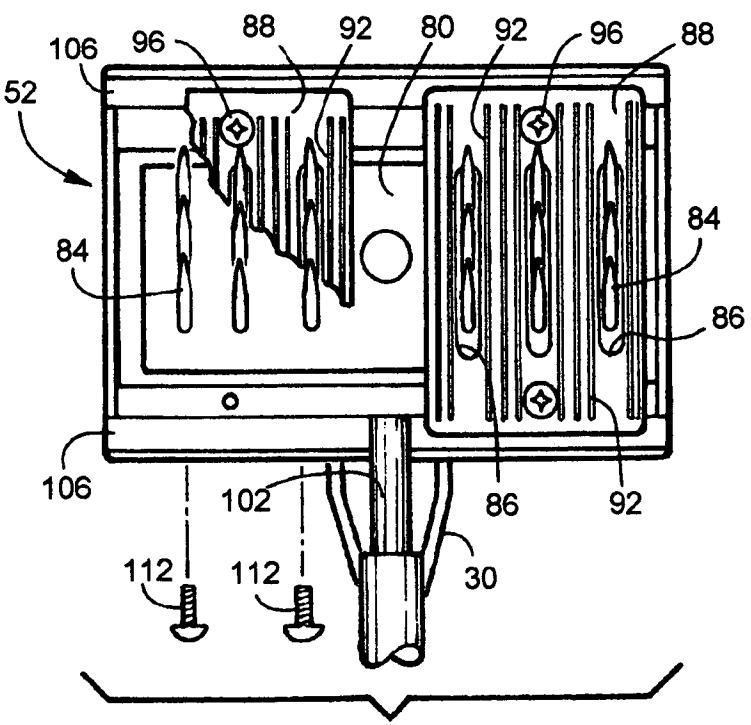
FIG. 6 depicts a bottom view of the head unit assembly with one of the gripper pads broken away showing the adjustable barbed plate, constructed in accordance with the present invention.
Figure 7:
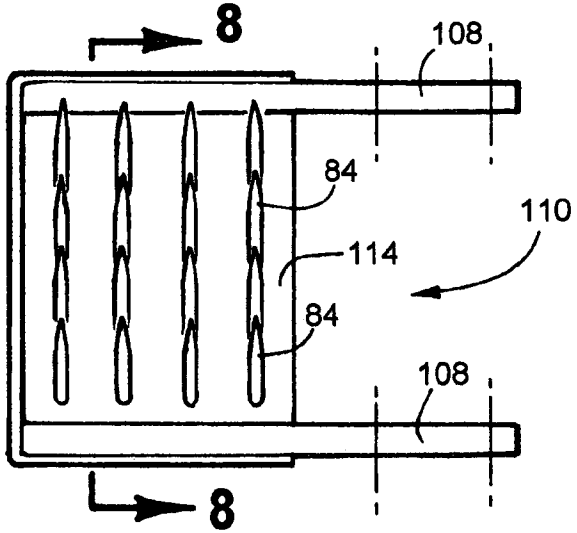
FIG. 7 depicts a bottom view of one of the side extension units, constructed in accordance with the present invention.
Figure 8:
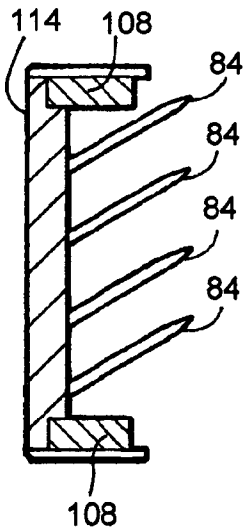
FIG. 8 depicts a section through one of the side extension units, constructed in accordance with the present invention.

FIG. 6 depicts a bottom view of the head unit assembly 52 with one of the conventional gripper pads 88 broken away showing the adjustable barbed plate 80. The alignment of the prongs 84 are shown within the slots 86 in the plastic sections 90 that have the sheet metal stamped teeth 92 imbedded into them. Two side unit extension mounting slots 106 translate through the front and back of the head unit assembly 52 for the engagement of the side unit extension mounting arms 108 on the side unit extensions 110 illustrated in FIG. 7, which may be inserted on either or both sides of the head unit assembly 52. Two mounting screws 112 retain the side unit extension mounting arms 108 within the two side unit extension mounting slots 106. The side unit extensions 110 are composed of the side unit extension mounting arms 108 attached to a top plate 114 with a plurality of rows of angled carpet engaging prongs 84. FIG. 8 further depicts the side unit extensions 110 by showing a cross section illustrating the angle of the prongs 84 and the location of the side unit extension mounting arms 108.

Figures 9, 10, 11, 12:
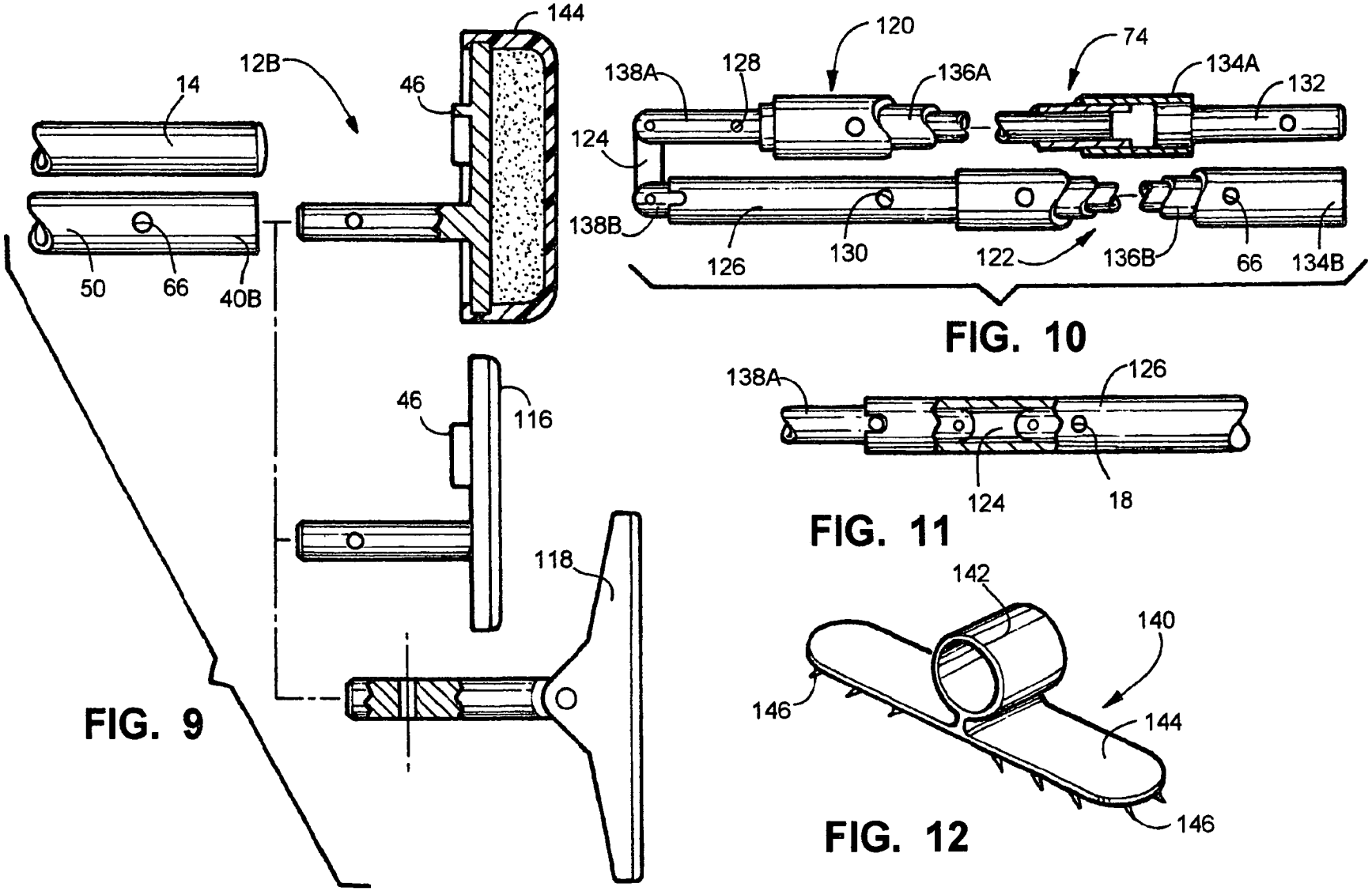
FIG. 9 depicts an alternate embodiment of the end of the carpet installation combination tool with a removable knee kicker pad attachment, a removable stationary wall pressure attachment, and a removable pivotal wall pressure attachment, constructed in accordance with the present invention.
FIG. 10 depicts the telescoping linked extension rod that is permanently linked together as a single unit, constructed in accordance with the present invention.
FIG. 11 depicts a plan view of the securing brace biased into the locking position and broken away in the center to reveal the link attachment, constructed in accordance with the present invention.
FIG. 12 depicts a perspective view of the unique anti-shift mechanism.

FIG. 9 depicts an exploded view of the end of the carpet installation combination tool 10 illustrating the alternate embodiment of the knee kicker portion 12B with a removable knee kicker pad attachment 114, a removable stationary wall pressure attachment 116, and a removable pivotal wall pressure attachment 118. All the attachments will be inserted into the distal end 40B of the lever arm extension tube 50 and locked into position by the means of a conventional locking pin 62.

FIG. 10 depicts the unique telescoping linked extension rod assembly 74 that is permanently linked together as a single unit. The telescoping linked extension rod assembly 74 consists of a head section 120 and a tail section 122 that are linked together by the means of a pivotal link 124. When the telescoping linked extension rod assembly 74 is opened and the head section 120 and a tail section 122 are parallel the securing brace 126 is slid into position on the alignment pin 128 and locked into position by the means of a spring loaded ball detent 18 engaging within a ball detent orifice 130. The head section 120 of the telescoping linked extension rod assembly 74 has a shaft 132 that is attached to the outer tubular telescoping section 134A. The shaft 132 has been designed to insert into the stretcher adapter 58 or the distal end 40B of the alternate embodiment of the knee kicker portion 12B and locked into position by the means of a conventional locking pin 62. The outer tubular telescoping section 134A slides over a second tubular telescoping section 136A that in turn slides over a central shaft 138A. The tail section 122 is constructed in similar fashion to the head section 120 with a central shaft 138B, second tubular telescoping section 136B. The exception is that the outer tubular telescoping section 134B does not have the shaft 132 so that the removable knee kicker pad attachment 114, a removable stationary wall pressure attachment 116, and a removable pivotal wall pressure attachment 118 may be inserted within the distal end 40B. FIG. 11 depicts a plan view of the securing brace 126 biased into the locking position and broken away in the center to revel the pivotal link 124 attachment.

FIG. 12 depicts a perspective view of the unique anti-shift mechanism 140 designed that one or more will slip over the telescoping linked extension rod assembly 74 to prevent any side movement. The device consists of a tubular member 142 that will slide over the outer tubular telescoping section 134A and 134B attached to a flat plate 144 with small carpet engaging prongs 146.

The carpet installation combination tool 10 shown in the drawings and described in detail herein discloses arrangements of elements of particular construction and configuration for illustrating preferred embodiments of structure and method of operation of the present invention. It is to be understood, however, that elements of different construction and configuration and other arrangements thereof, other than those illustrated and described, may be employed for providing a carpet installation combination tool 10 in accordance with the spirit of this invention and such changes, alternations and modifications as would occur to those skilled in the art are considered to be within the scope of this invention as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

I claim:

1. A carpet installation combination tool comprising:

a) a knee kicker assembly, said knee kicker assembly comprising:

i) a head unit assembly, said head unit assembly including a main plate, a mounting plate coupled to said main plate, one or more spacer blocks coupled to said main plate, and an adjustable prong plate coupled to said main plate, said adjustable prong plate containing a plurality of angled prongs for the purpose of engaging carpet, ii) a lever arm assembly pivotally attached to said head unit assembly, said lever arm assembly consisting of a lever arm central tubular member having a conventional spring-loaded ball detent, one end of said lever arm central tubular member formed into a yoke section for the purpose of attachment to said head mounting plate, a lever arm extension tube slidably disposed over said lever arm central tubular member and containing a plurality of orifices through which said conventional spring-loaded ball detent can be disposed, a lever arm hinge bracket coupled to said lever arm central tubular member, and a pressure arm coupled to said lever arm hinge bracket, iii) an extendable pressure rod assembly fixed to said head unit assembly, said extendable pressure rod assembly comprising a pressure rod mounting shaft rigidly fixed to said main plate, a pressure rod sliding tubular member attached to said pressure rod mounting shaft and having a conventional spring-loaded ball detent, and a pressure rod extension tube slidably disposed over said pressure rod mounting shaft and containing a plurality of orifices through which the conventional spring-loaded ball detent can be disposed, iv) a pivot insert slidably disposed within said pressure rod mounting shaft and coupled to said pressure arm for the purpose of lengthening said pressure arm and exerting axial force against said pressure rod mounting shaft, and v) a knee kicker pad assembly coupled to the distal end of said extendable pressure rod assembly for the purpose of softening the impact on a user's knee during use of the knee kicker assembly;

b) a stretcher adapter removably attached to said knee kicker assembly, said stretcher adapter comprising a support plate, a hinged clamp mechanism fixed to one end of said support plate for the purpose of clamping around the distal end of said pressure rod extension tube, said hinged clamp mechanism containing a pair of oppositely situated locking pin orifices through which a first locking pin can be removably disposed, an extension rod receiver fixed to the other end of said support plate for the purpose of receiving an extension rod, said extension rod receiver containing a pair oppositely situated locking pin orifices through which a second locking pin can be removably disposed, and a first locking pin for the purpose of securing said pressure rod extension tube to said hinged clamp mechanism;

c) a telescoping linked extension rod assembly coupled to said extension rod receiver for the purpose of providing carpet stretching capability, said telescoping linked extension rod comprising a head portion connected to a tail portion by a pivotal link, said head portion comprising a first central shaft containing an alignment pin on one end, a first inner tubular telescoping section slidably disposed over said first central shaft, a first outer tubular telescoping section slidably disposed over said first inner tubular telescoping section, one end of said first outer tubular telescoping section designed to receive one end of a shaft, the other end of said shaft designed to insert into said extension rod receiver, said tail portion comprising a second central shaft containing a conventional spring loaded ball detent, a second inner tubular telescoping section slidably disposed over said second central shaft, and a second outer tubular telescoping section slidably disposed over said second inner tubular telescoping section; and d) a removable wall pressure attachment coupled to the distal end of said telescoping linked extension rod for the purpose of enabling the stretching of carpet by use of the force provided by the wall opposite the direction of the stretching of the carpet, whereby a user uses the carpet installation combination tool as a knee kicker tool by using said lever arm assembly to drive said plurality of prongs into the carpet and then uses a knee to exert axial force upon said knee kicker pad assembly to stretch the carpet, and uses the carpet installation combination tool as a stretcher tool by attaching said stretcher adapter to said knee kicker assembly, attaching said telescoping linked extension rod to said stretcher adapter, attaching said removable wall pressure attachment to said telescoping linked extension rod, and using an downward force on said lever arm assembly to exert an axial force upon said head mounting assembly to cause said plurality of prongs to stretch the carpet.

2. The carpet installation combination tool of claim 1, wherein said head unit assembly further comprises a hand knob coupled to said mounting plate and said main plate for the purpose of adjusting the height of said adjustable prong plate.

3. The carpet installation combination tool of claim 1, wherein said plurality of prongs are aligned to match slots in one or more conventional gripper pads that can be removably fixed to said main plate.

4. The carpet installation combination tool of claim 1, wherein said lever arm central tubular member is pivotally attached to said head mounting plate by a pivot pin engaged between two brackets attached to said head mounting plate.

5. The carpet installation combination tool of claim 1, wherein said knee kicker pad assembly contains a mounting plate with a lever arm locking support for the purpose of supporting the distal end of said lever arm extension tube.

6. The carpet installation combination tool of claim 1, further comprising an anti-shift mechanism slidably disposed over said telescoping linked extension rod assembly for the purpose of preventing movement of said telescoping linked extension rod, said anti-shift mechanism containing a tubular member coupled to a flat plate, said flat plate containing a plurality of carpet-engaging prongs.

7. The carpet installation combination tool of claim 1, further comprising a tubular securing brace slidably disposed over said second central shaft and containing a ball detent orifice on one end and an alignment pin orifice on the other end, whereby when said head portion, tail portion, and intermediate link are all aligned, said securing brace is slidably translated to a position where said alignment pin is engaged with said alignment pin orifice and through which the conventional spring loaded ball detent of said second central shaft is disposed through said ball detent orifice, securing said telescoping linked extension rod assembly into an aligned position.

8. The carpet installation combination tool of claim 3, wherein said one or more conventional gripper pads are attached by screws into one or more spacer blocks, said spacer blocks being attached by screws into said main plate.

9. A carpet installation combination tool comprising:

a) a knee kicker assembly, said knee kicker assembly comprising:

i) a head unit assembly, said head unit assembly containing a main plate, a mounting plate coupled to said main plate, one or more spacer blocks coupled to said main plate, and an adjustable prong plate coupled to said main plate, said adjustable prong plate containing a plurality of angled prongs for the purpose of engaging carpet, ii) a lever arm assembly pivotally attached to said head unit assembly, said lever arm assembly consisting of a lever arm central tubular member having a conventional spring-loaded ball detent, one end of said lever arm central tubular member formed into a yoke section for the purpose of attachment to said head mounting plate, a lever arm extension tube slidably disposed over said lever arm central tubular member and containing a plurality of orifices through which said conventional spring-loaded ball detent can be disposed, a lever arm hinge bracket coupled to said lever arm central tubular member, and a pressure arm coupled to said lever arm hinge bracket, iii) an extendable pressure rod assembly fixed to said head unit assembly, said extendable pressure rod assembly comprising a pressure rod mounting shaft rigidly fixed to said main plate, a pressure rod sliding tubular member attached to said pressure rod mounting shaft and having a conventional spring-loaded ball detent, and a pressure rod extension tube slidably disposed over said pressure rod mounting shaft and containing a plurality of orifices through which said conventional spring-loaded ball detent can be disposed, iv) a pivot insert slidably disposed within said pressure rod mounting shaft and coupled to said pressure arm for the purpose of lengthening said pressure arm and exerting axial force against said pressure rod mounting shaft, and v) a removable attachment coupled to the distal end of said extendable pressure rod assembly for the purpose of allowing various uses of said knee kicker assembly;

b) a stretcher adapter removably attached to said knee kicker assembly, said stretcher adapter comprising a support plate, a hinged clamp mechanism fixed to one end of said support plate for the purpose of clamping around the distal end of said pressure rod extension tube, said hinged clamp mechanism containing a pair of oppositely situated locking pin orifices through which a first locking pin can be removably disposed, an extension rod receiver fixed to the other end of said support plate for the purpose of receiving an extension rod, said extension rod receiver containing a pair oppositely situated locking pin orifices through which a second locking pin can be removably disposed, and a first locking pin for the purpose of securing said pressure rod extension tube to said hinged clamp mechanism; and c) a telescoping linked extension rod assembly coupled to extension rod receiver for the purpose of providing carpet stretching capability, said telescoping linked extension rod comprising a head portion connected to a tail portion by a pivotal link, said head portion comprising a first central shaft containing an alignment pin on one end, a first inner tubular telescoping section slidably disposed over said first central shaft, a first outer tubular telescoping section slidably disposed over said first inner tubular telescoping section, one end of said first outer tubular telescoping section designed to receive one end of a shaft, the other end of said shaft designed to insert into said extension rod receiver, said tail portion comprising a second central shaft containing a conventional spring loaded ball detent, a second inner tubular telescoping section slidably disposed over said second central shaft, and a second outer tubular telescoping section slidably disposed over said second inner tubular telescoping section whereby a user uses the carpet installation combination tool as a knee kicker tool by using said lever arm assembly to drive said plurality of prongs into the carpet and then uses a knee to exert axial force upon said knee kicker pad assembly to stretch the carpet, and uses the carpet installation combination tool as a stretcher tool by attaching said stretcher adapter to said knee kicker assembly, attaching said telescoping linked extension rod to said stretcher adapter, attaching said removable attachment to said telescoping linked extension rod, and using an downward force on said lever arm assembly to exert an axial force upon said head mounting assembly to cause said plurality of prongs to stretch the carpet.

10. The carpet installation combination tool of claim 9, wherein said removable attachment comprises a knee kicker pad assembly for the purpose of softening the impact on a user's knee during use of the knee kicker assembly.

11. The carpet installation combination tool of claim 9, wherein said removable attachment comprises a stationary wall pressure attachment for the purpose of enabling the stretching of carpet by use of the force provided by the wall opposite the direction of the stretching of the carpet.

12. The carpet installation combination tool of claim 9, wherein said removable attachment comprises a pivotal wall pressure attachment for the purpose of enabling the stretching of carpet by use of the force provided by the wall opposite the direction of the stretching of the carpet.

13. The carpet installation combination tool of claim 9, wherein said head unit assembly further comprises a hand knob coupled to said mounting plate and said main plate for the purpose of adjusting the height of said adjustable prong plate.

14. The carpet installation combination tool of claim 9, wherein said plurality of prongs are aligned to match slots in one or more conventional gripper pads that can be removably fixed to said main plate.

15. The carpet installation combination tool of claim 9, wherein said lever arm central tubular member is pivotally attached to said head mounting plate by a pivot pin engaged between two brackets attached to said head mounting plate.

16. The carpet installation combination tool of claim 9, further comprising an anti-shift mechanism that is slidably disposed over said telescoping linked extension rod assembly for the purpose of preventing movement of said telescoping linked extension rod, said anti-shift mechanism containing a tubular member coupled to a flat plate, said flat plate containing a plurality of carpet-engaging prongs.

17. The carpet installation combination tool of claim 9, further comprising a tubular securing brace slidably disposed over said second central shaft and containing a ball detent orifice on one end and an alignment pin orifice on the other end, whereby when said head portion, tail portion, and intermediate link are all aligned, said securing brace is slidably translated to a position where said alignment pin is engaged with said alignment pin orifice and through which the conventional spring loaded ball detent of said second central shaft is disposed through said ball detent orifice, securing said telescoping linked extension rod assembly into an aligned position.

18. The carpet installation combination tool of claim 10, wherein said knee kicker pad assembly contains a mounting plate with a lever arm locking support for the purpose of supporting the distal end of said lever arm extension tube.

19. The carpet installation combination tool of claim 14, wherein said one or more conventional gripper pads are attached by screws into one or more spacer blocks, said spacer blocks being attached by screws into said main plate.

* * * * *